United States Patent [19]

Matlock et al.

[11] Patent Number: 4,883,545

[45] Date of Patent: Nov. 28, 1989

[54] PROCESS FOR MAKING A METALLIC ARTICLE WITH IMPROVED RESISTANCE TO SURFACE CRACKING DURING COLD FORMING

[75] Inventors: David K. Matlock, Golden; Michael P. Riendeau, Lakewood, both of Colo.; Mark L. Robinson, Wyomissing Hills, Pa.

[73] Assignee: Colorado School of Mines, Golden, Colo.

[21] Appl. No.: 239,457

[22] Filed: Sep. 1, 1988

[51] Int. Cl.[4] ..... C22C 8/06

[52] U.S. Cl. ..... 148/12 B; 148/12 E; 148/902

[58] Field of Search ..... 148/12 B, 12 F, 12 R, 148/320, 327, 902

[56] References Cited

FOREIGN PATENT DOCUMENTS

| | | | |
|---|---|---|---|
| 528521 | 7/1956 | Canada | 148/12 B |
| 60-262981 | 12/1985 | Japan | 148/12 B |
| 62-27521 | 2/1987 | Japan | 148/12 B |

OTHER PUBLICATIONS

J. K. Lee et al., *An Analysis for the Effect of a Grain Size Gradient on Torsional and Tensile Properties,* 19A Metallurgical Transactions A (Feb. 1988).

C. L. Girolami et al., *Effects of Cold Bar Drawing on Workability in Subsequent Upsetting,* Conf. Proceedings 12 NAMRC (1984).

D. K. Matlock & D. A. Burford, *An Experimental Correlation of Plane Strain Deformation Zone Geometry and Forming Loads,* Jour. of Applied Metalworking, vol. 4, No. 4 (Jan. 1987).

W. A. Backofen, *Deformation Processing,* pp. 88–106 & 135–139, Addison-Wesley (1972).

EPO Patent Application Publ. No. 0218167, Takahashi and Asano (Apr. 15, 1987).

J. L. Tevaarwerk et al., *The Influence of Prior Cold Working and the Consideration of Die Design on the Cold Headability of 1020 Steel Wire Using an Instrumented Double Blow Heading Machine,* Z. Metallkunde, Bd. 63 (1972).

M. Kojima and Y. Tozawa, *Anisotropic Behaviour of Pre-Drawn Materials in Upsetting-Study on Upsetting of Pre-Deformed Material III,* Jour. of Jap. Soc. Technology, vol. 13, No. 133 (1972).

F. Gill & W. M. Baldwin, Jr., *Proper Wiredrawing Improves Cold Heading,* Metal Progress (Feb. 1964).

*Primary Examiner*—Deborah Yee

*Attorney, Agent, or Firm*—Dann, Dorfman, Herrell and Skillman

[57] ABSTRACT

A process for improving the cold workability of a metallic article is disclosed. The process includes compressive working followed by heat treatment of a metallic article to provide a duplex microstructure including relatively fine grains near the surface and relatively coarse grains near the center of the article. The duplex microstructure improves the surface cracking resistance of the article during subsequent compressive cold forming, such as by cold heading.

10 Claims, 3 Drawing Sheets

$$\Delta_w = \frac{a}{r}\left[1+\sqrt{1-r}\right]^2$$

100X

400X

400X $$\Delta_w = \frac{\alpha}{r}\left[1+\sqrt{1-r}\right]^2$$

$$\Delta = \frac{h}{L}$$

PROCESS FOR MAKING A METALLIC ARTICLE WITH IMPROVED RESISTANCE TO SURFACE CRACKING DURING COLD FORMING

This invention relates to a method for improving the cold workability of a metallic article, and in particular to a method which includes mechanically working and heat treating a metallic article to improve its cold workability.

Heretofore, it has been known that certain types of pre-working of elongated articles, such as wire, rod or bar, which are to be subsequently cold worked as by a cold forging process, e.g. cold heading, are beneficial to the performance of such elongated articles during cold working. Cold heading, for example, is a cold working process in which a compressive force is applied to the end of a wire to form a fastener "head" such as a bolt head or a rivet head, by upsetting the end of the wire. The magnitude of deformation which can be achieved during the heading process is limited by compressive ductility of the wire. Cracking, which nucleates at the outer surface of the cold worked head can occur when the heading wire is insufficiently ductile. Such cracking results in undesirable waste of material.

The aforementioned pre-working includes such processes as pre-drawing, shot-blasting or -peening and roller burnishing which result in residual compressive stresses in the surface of the article. However, the improvement in cold working performance, i.e. in resistance to surface cracking, resulting from such processes has left much to be desired.

A known wire product manufactured in a foreign country has been found to have a good combination of surface ductility and low strength which are desirable in an article to be cold headed or otherwise cold upset. The wire has a composite microstructure including fine grains near the wire surface and coarse grains near the wire center. The process by which that product was made is not known.

Hitherto, it has also been known to produce a gradient grain structure in bars by twisting and then annealing of the twisted bar. Such a process, however, is limited to round forms and leaves much to be desired for continuous, large scale production of a cold workable article such as heading wire.

SUMMARY OF THE INVENTION

The problems associated with the above-described processes are solved to a significant degree in a process, according to the present invention, for improving the surface cracking resistance of a cold-workable metallic article. The process includes providing a starting form of a cold-workable metallic material which has been previously worked, with or without thermal treatment. The starting form is compressively worked to provide an intermediate form having a strain gradient between the surface of the intermediate form and the center thereof. The compressive working must be carried out below the recrystallization temperature of the metallic material. After the compressive working step, the intermediate form is thermally treated to at least partially recrystallize the metallic material near the surface, but with no significant grain growth.

The strain gradient imposed on the starting form by compressively working it is selected such that the strain near the surface of the intermediate form is great enough that, following thermal treatment, a relatively fine-grained structure is formed near the surface of the thermally treated intermediate form. Furthermore, the strain near the center of the intermediate form is low enough to result in a relatively coarse-grained structure near the center of the thermally treated intermediate form. The desired strain gradient is preferably attained by controlling the deformation zone geometry during the compressive working and the amount of reduction in cross-sectional area.

DETAILED DESCRIPTION

The process according to the present invention includes compressive working and heat treating, which when applied to a previously worked metallic form, such as wire or rod, results in an intermediate form having a composite or duplex grain structure or microstructure. Such a composite microstructure is characterized by a fine-grained structure near the surface of the intermediate form and a coarse-grained structure near the center of the form. The fine-grained, near-surface structure advantageously provides a ductile region which is resistant to cracking during subsequent compressive cold forming, such as by cold heading. The coarse-grained, central structure provides desirably lower strength to facilitate such cold working processes.

Figure 4B:
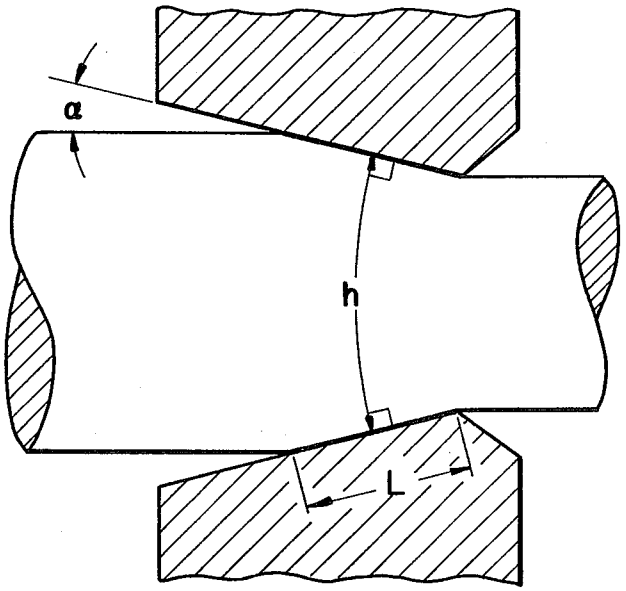
FIGS. 4A and 4B are elevational views in partial cross-section showing deformation devices used in the process of the present invention for reducing metallic articles, FIG. 4A showing parallel indenters and FIG. 4B showing a converging channel.
Figure 4A:
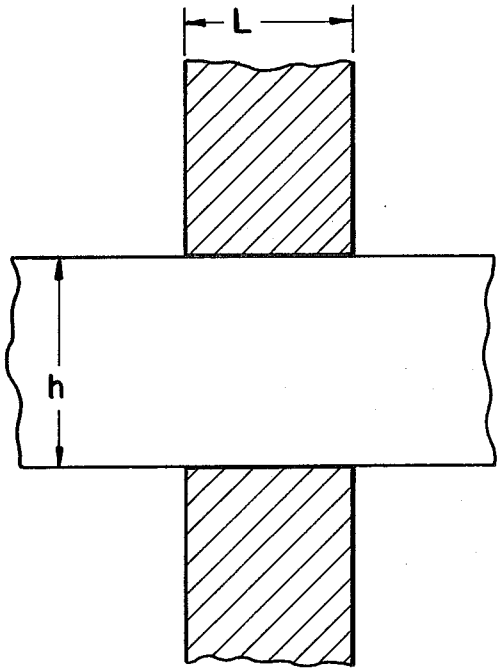

The process is applicable to metals and alloys which are cold-workable, that is to say metallic materials which are malleable below the recrystallization temperature. Although useful with a variety of starting shapes, the process is particularly advantageous in connection with round wire and rod forms. A starting shape, such as wire, rod, or other worked form is provided. If the starting shape has been cold-worked, then it preferably should be annealed.

the process according to the present invention includes compressively working the starting form to provide an intermediate form having a strain gradient oriented radially between the surface and the center of the intermediate form. The imposed strain is preferably concentrated near the surface of the form. The compressive working must be carried out below the recrystallization temperature of the metallic material. Working below the recrystallization temperature includes cold working and/or warm working. The strain gradient is accomplished by controlling the geometry of the deformation zone of the particular compressive working apparatus employed and the amount of reduction in cross-sectional area of the metallic form. The deformation zone geometry is conveniently defined by the parameter Δ and the areal reduction by the parameter r as discussed by W. Backofen in Chapter 5 of his treatise, "Deformation Processing" (Addison Wesley 1972). As defined therein, Δ is the mean thickness-to-length ratio of the deformation zone. For parallel indenters as shown in FIG. 4A, such as in a mechanical press, Δ is the ratio of the height, h, to the length, L, of the zone between the indenters. For a converging channel as shown in FIG. 4B, such as a wire drawing die or roller die, Δ is the ratio of the circular arc length midway through the deformation zone drawn to meet the die or roller surfaces at right angles, and the contact length, L, of the workpiece with the die or roller.

Δ can be defined for a variety of deformation devices. For example, for an axisymmetric wire drawing die, Δ is determined by the following relationship:

$$\Delta = \frac{\alpha}{r}(1 + \sqrt{1 - r})^2 \quad (1)$$

In Equation (1), α represents one-half the effective convergence angle in radians and r is the areal reduction in a single pass, see Eq. 2 below. In a static wiredrawing die the effective convergence angle is the die angle, whereas in a roller die the effective convergence angle must be determined geometrically. The effective convergence angle (2α) of the deformation device is preferably 10°–64°.

The areal reduction, r, can be represented by the relationship:

$$r = 1 - \left(\frac{A_1}{A_o}\right) \quad (2)$$

where $A_o$ is the cross-sectional area of the starting form and $A_1$ the resulting cross-sectional area after compressive working.

It is a unique feature and distinct advantage of the process of the present invention that the strain gradient resulting from deformation during compressive working can be varied as desired by controlling the deformation zone geometry parameter Δ. For example, the strain gradient can be concentrated near the surface of the intermediate metallic form during cold working when the cold working device has a deformation zone geometry parameter of at least about 8.

The strain gradient imposed by the compressive working step must be such that the amount of strain at and near the surface of the intermediate form is above a critical level. Such critical level is great enough to result in a relatively fine-grained structure near the surface of the intermediate form upon subsequent thermal treatment. Likewise, the amount of strain near the center of the intermediate form must be low enough to result in a relatively coarse-grained structure near the center of the intermediate form during the aforesaid thermal treatment. The desired strain gradient in the intermediate form is controlled by proper selection of the convergence angle and/or the amount of reduction per pass during compressive working. Preferably, the convergence angle and the percent reduction per pass or per reducing step are selected to provide the desired strain gradient in a single pass or reducing step.

The intermediate metallic form is thermally treated, for example as by annealing, subsequent to being worked, in order to bring out the desired duplex microstructure. Such annealing is carried out for a time and at a temperature such that the particular alloy or metal is at least partially recrystallized at and near the surface. The annealing time and temperature, however, must be controlled to avoid any significant grain growth and preferably to avoid any grain growth at all. The heat treatment is preferably adjusted with respect to time and/or temperature, depending on the total amount of areal reduction employed, to provide the desired recrystallization. the annealing time and temperature conditions can be readily determined for a specific metal or alloy by known methods.

EXAMPLE

As an example of the process of the present invention, cold drawn, recrystallized 0.136 in diameter, austenitic stainless steel wire was provided having the composition in weight percent in Table I which is that of a commercially available heading wire. Recrystallization had been carried out at 1065C followed by water quenching but is not a necessary step of the present process.

TABLE I

| | |
|---|---|
| C | 0.020 |
| Mn | 1.49 |
| Si | 0.51 |
| P | 0.029 |
| S | 20 ppm |
| Cr | 17.82 |
| Ni | 9.70 |
| Mo | 0.57 |
| Cu | 3.57 |
| Co | 0.31 |
| V | 0.12 |
| N | 0.020 |
| O | 66 ppm |
| Cb | 0.08 |
| W | 0.11 |
| Fe | Bal. |

The starting wire was drawn in accordance with the schedule shown in Table II which also shows the

TABLE II

| Pass No. | Diam (in) | % Red./pass | % Red. | Δ |
|---|---|---|---|---|
| 1 | 0.1305 | 7.9 | 7.9 | 6.8 |
| 2 | 0.1290 | 2.3 | 10.0 | 21.1 |
| 3 | 0.1258 | 4.9 | 14.4 | 9.7 |
| 4 | 0.1226 | 5.0 | 18.7 | 9.5 |

finish diameter after each pass (Diam) in inches, the percent reduction per pass (% Red./pass), the percent reduction overall (% Red.) and the deformation zone geometry parameter per pass (Δ). The drawing die used in pass 1 had a convergence angle (2α) of 16°, whereas the dies used in passes 2–4 each had a convergence angle of 14°.

An annealing survey was performed on the wire from each pass. Individual samples were cut from the wire after each pass and annealed at 750C, 825C, and 900C respectively for 30 minutes in order to effect recrystallization. The results of metallographic analysis of each annealed wire sample are shown in Table III as a rating of the degree of recrystallization observed at both the surface and the center of each sample.

TABLE III

| Pass No. | Annealing Temp. 750 C. Surface/Center | 825 C. Surface/Center | 900 C. Surface/Center |
|---|---|---|---|
| 1 | N/N | N/N | N/N |
| 2 | N/N | N/N | N/N |
| 3 | N/N | N/N | P/N |
| 4 | N/N | N/N | P/N |

In Table III "N" indicates no observed recrystallization and "P" indicates partial recrystallization. Table III shows that partial recrystallization occurred only near the surface of the wire after annealing at 900C of passes 3 and 4. Such result is desirable because it indicates a duplex grain structure and because it occurs within the temperature range of commercial annealing operations for the type of stainless steel wire used in the test. The 900C annealed wires from passes 3 and 4 can be readily cold headed in the usual way to form useful articles such as bolts or rivets.

It is noted that the annealed wire from pass 1 having a deformation zone geometry parameter less than 8 did not recrystallize at any of the test temperatures. The data suggests that annealed wire from pass 2 did not recrystallize at any of the test temperatures because of insufficient reduction to achieve the critical strain near the surface. Recrystallization at a somewhat higher temperature than 900C of the wire from pass 2 can be accomplished for the purpose of this invention but only if the minimum strain had been imparted to the near surface grains of the wire that is required for the desired transformation to take place without unacceptable grain growth.

Figure 1:
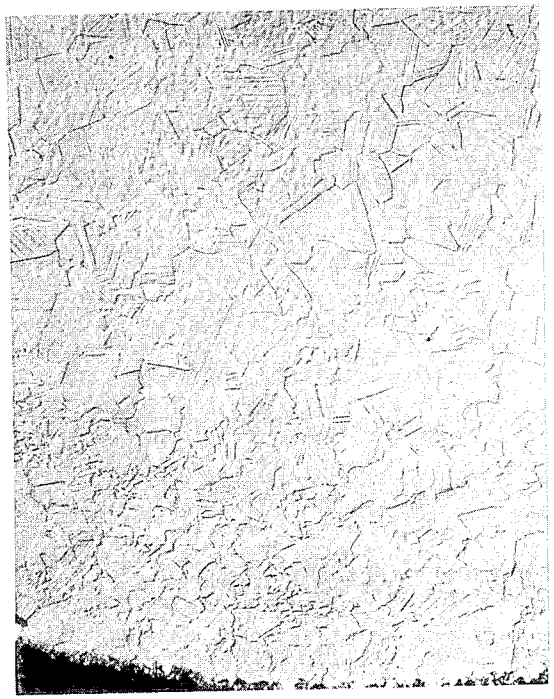
FIG. 1 is a photomicrograph at 100x showing a transverse section of stainless steel wire processed in accordance with the present invention and electrolytically etched with 10% oxalic acid, the wire surface being on the right and the center being toward the left.
Figure 2:
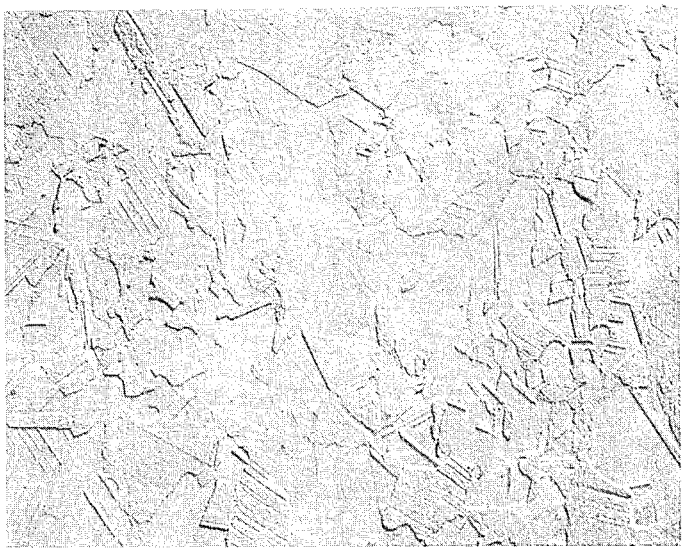
FIG. 2 is a micrograph at 400x showing partially recrystallized fine grains at and near the surface of the wire section of FIG. 1.
Figure 3:
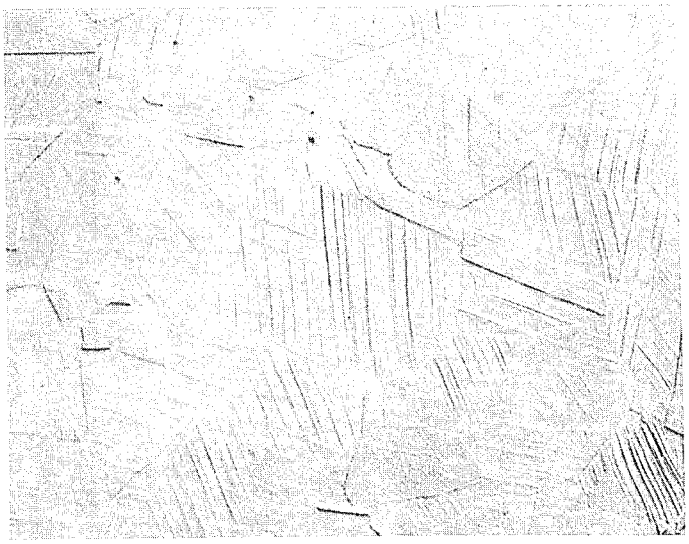
FIG. 3 is a micrograph at 400x showing the unrecrystallized coarse grains near the center of the wire section of FIG. 1.

FIGS. 1, 2, and 3 are photomicrographs of a transverse section of the wire from pass 4 after annealing at 900C for 30 minutes. FIG. 1 shows the gradient or duplex microstructure of the annealed wire comprising small, relatively fine grains at and near the surface (on the right) and larger, relatively coarse grains near the center (to the left). FIG. 2 clearly shows the much finer grain size, about ASTM 8–9, near the wire surface compared with FIG. 3 which shows the coarse, unrecrystallized grains, about ASTM 4–5, near the center of the wire. Thus, for austenitic stainless upsetting wire, a grain size difference from surface to core of about 3 to 5 on the ASTM scale is desirable.

The process according to the present invention provides a novel combination of compressive working and heat treating a previously worked metallic form to improve the performance of the metallic form when subsequently cold worked. After being thus processed the intermediate form with a duplex grain structure is then compressively cold worked to a final or near-final shape as by upsetting or cold heading to form a wide variety of products with a significant reduction in scrap resulting from surface cracking. Such products include, for example, bolts, nuts, rivets, ball bearings, studs, knuckle ball studs, clevis pins, nails, automotive valves and blanks for more complex product shapes, such as gears.

The terms and expressions which have been employed are used as terms of description and not of limitation. There is no intention in the use of such terms and expressions of excluding any equivalents of the features shown and described or portions thereof. It is recognized, however, that various modifications are possible within the scope of the invention claimed.

What is claimed is:

1. A process for making a metallic article with improved resistance to surface cracking during cold forming, comprising the steps of:

providing a substantially cylindrical starting metallic form which has been previously worked, with or without thermal treatment;

compressively working said starting form by axisymmetrically reducing the cross-sectional area thereof so as to provide an intermediate form having a strain gradient between the surface and the center of said intermediate form, said compressive working being carried out below the recrystallization temperature of the metallic material, said axisymmetric reduction being carried out in a deformation zone having a deformation zone geometry parameter ($\Delta$) of at least about 8; and then thermally treating said intermediate form to at least partially recrystallize the metallic material near the surface but with no significant grain growth;

said strain gradient being such that the strain near the surface of said intermediate form is great enough to result in a relatively fine-grained structure near the surface of the thermally treated intermediate form and the strain near the center of said intermediate form is low enough to result in a relatively coarse-grained structure near the center of the thermally treated intermediate form.

2. A process as set forth in claim 1 wherein the step of compressively working the starting form is carried out near room temperature.

3. A process as set forth in claim 1 wherein said deformation zone is formed in an axisymmetric deformation device having a convergence half-angle ($\alpha$) and a diameter to provide a reduction per pass (r) sufficient to provide the deformation zone geometry parameter ($\Delta$) of at least 8 in accordance with the relationship:

$$\Delta = \frac{\alpha}{r}(1 + \sqrt{1 - r})^2.$$

4. A process as set forth in claim 5 wherein the deformation device is selected to have a convergence angle ($2\alpha$) of about 10° to 64°.

5. A process as set forth in claim 1 wherein the thermal treating step includes heating the intermediate form at a temperature above the recrystallization temperature.

6. A process as set forth in claim 5 wherein the heating is limited in time and temperature to avoid significant grain growth.

7. A process of making wire having improved resistance to surface cracking during subsequent compressive cold forming thereof, said process comprising the steps of:

providing a cold-workable wire formed from a worked metallic material;

compressively working said wire to axisymmetrically reduce its cross-sectional area so as to provide an intermediate wire form having a strain gradient extending between the surface and the core of said intermediate wire form, said compressive working being carried out below the recrystallization temperature of the metallic material, said axisymmetric reduction of the wire cross-sectional area being carried out in a deformation zone having a deformation zone geometry parameter of at least about 8; and then heat treating said intermediate wire form to at least partially recrystallize it near its surface but with substantially no significant grain growth;

said strain gradient being such that the strain imposed near the surface of said intermediate wire form is great enough to result in a relatively fine-grained structure near the surface of the heat treated intermediate wire form and the strain imposed near the core of said intermediate wire form is low enough to result in a relatively coarse-grained structure near the center of the heat treated intermediate wire form.

8. A process as set forth in claim 7 wherein the step of compressively working the wire is carried out near room temperature.

9. A process as set forth in claim 7 wherein the compressive working step comprises drawing the wire through a drawing die having an effective convergence half-angle ($\alpha$) and which provides a reduction per pass (r) sufficient to provide a deformation zone geometry parameter ($\Delta$) of at least 8 as determined by the relationship:

$$\Delta = \frac{\alpha}{r}(1 + \sqrt{1 - r})^2$$

10. A process as set forth in claim 9 wherein the drawing die is selected to have a convergence angle ($2\alpha$) of about 10°–64°.

* * * * *

UNITED STATES PATENT AND TRADEMARK OFFICE

CERTIFICATE OF CORRECTION

PATENT NO. : 4,883,545

DATED : November 28, 1989

INVENTOR(S) : DAVID K. MATLOCK, et al.

It is certified that error appears in the above-identified patent and that said Letters Patent is hereby corrected as shown below:

Column 2,

Line 54, "the" should read --The--. (1st occurrence)

Column 4,

Line 10, after "crystallization.", "the" should read --The--.

Claims,

Claim 4, line 1, after "claim", "5" should read --3--.

Signed and Sealed this

Thirtieth Day of October, 1990

*Attest:*

*Attesting Officer*

HARRY F. MANBECK, JR.

*Commissioner of Patents and Trademarks*